US005131870A

United States Patent [19]

El-Haj

[11] Patent Number: 5,131,870

[45] Date of Patent: Jul. 21, 1992

[54] HIGH-CURRENT ELECTRICAL ACCESSORY PLUG

[75] Inventor: Ali El-Haj, Bridgeport, Conn.

[73] Assignee: Casco Products Corporation, Bridgeport, Conn.

[21] Appl. No.: 751,099

[22] Filed: Aug. 28, 1991

[51] Int. Cl.[5] ..... H01R 17/18

[52] U.S. Cl. ..... 439/668; 439/638; 439/824

[58] Field of Search ..... 439/668, 669, 34, 824, 439/700, 825, 842, 843, 846, 848, 851, 638, 639; 219/255-260

[56] References Cited

U.S. PATENT DOCUMENTS

| | | | |
|---|---|---|---|
| 513,949 | 1/1894 | Munson | 439/700 |
| 2,495,657 | 1/1950 | Kroll et al. | 219/260 |
| 4,054,352 | 10/1977 | Rudin | 439/638 |
| 4,319,798 | 3/1982 | Mittelhauser | 439/638 |
| 4,988,315 | 1/1991 | Wharton | 439/668 |

FOREIGN PATENT DOCUMENTS

| | | | |
|---|---|---|---|
| 1322977 | 2/1962 | France | 219/260 |
| 463621 | 5/1951 | Italy | 219/260 |
| 372184 | 11/1963 | Switzerland | 219/260 |

*Primary Examiner*—David L. Pirlot

*Attorney, Agent, or Firm*—Mitchell D. Bittman; H. Gibner Lehmann; K. Gibner Lehmann

[57] ABSTRACT

An electrical accessory plug for insertion in the socket of an automobile cigar lighter receptacle of the type provided with a grounded shell and live resilient clip contact fingers which have a rigid mounting. The plug has electrical conductor strips for connection to an electrical cord, and has at its inner end a retainer shoulder adapted to engage and to be frictionally embraced and retained by the live clip contact fingers of the cigar lighter receptacle. A spring-biased contact plunger at the inner end of the plug is connected to one of conductor strips. The plunger is adapted for abutting engagement under spring pressure, with the rigid mounting of the contact fingers of the cigar lighter receptacle when the plug body is positioned deeply in the receptacle.

15 Claims, 2 Drawing Sheets

HIGH-CURRENT ELECTRICAL ACCESSORY PLUG

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to electrical accessory plugs, and more particularly to plugs of the type intended for installation in a cigar lighter socket or receptacle mounted in the dashboard or other panel of a motor vehicle or boat.

2. Description of the Related Art Including Information Disclosed Under 37 CFR §§1.97-1.99

U.S. Pat. No. 3,870,857 dated Mar. 11, 1975, issued to L. G. Horwitt and D. J. Mattis, and entitled CIGAR LIGHTER IGNITING UNIT, illustrates and describes a typical cigar lighter/socket assembly as commonly employed in automotive and/or marine vehicles. The socket is constituted as an electrically grounded well, with an electrically hot stud insulatedly mounted therein. The stud carries bimetallic fingers, by which electrical connection to the heating element cup of the ignitor plug is established when the igniting unit is inserted in the well.

Sockets of this general type can also accept accessory plugs similar to that shown in FIG. 15 of co-pending application U.S. Ser. No. 07/580,334 filed Sept. 10, 1990, in the names of Ali El-Haj, Donald J. Mattis, and Mark Michael, entitled POWER OUTLET FOR ELECTRICAL ACCESSORIES, and having common ownership with the present application.

Accessory plugs such as that illustrated generally have a cylindrical body which telescopes into the socket. The body in turn carries a contact or plunger at its inner end, for engagement with the head of the hot stud of the socket. The plug body usually has a side terminal in the form of a flat lug, which electrically contacts the inner surface of the socket, to complete the electrical circuit.

While plugs of this kind have met with wide acceptance in the field, and operate in a generally satisfactory manner, a number of drawbacks have become apparent. Due to the sliding fit between the plug body and the walls of the socket, the contact pressure at the pin is limited to that obtainable by the frictional engagement of the plug and socket walls. Where the pin surface is not perfectly clean, the electrical continuity can be marginal or erratic, causing undesirable heating at the points of contact, or arcing, which in turn leads to further contact degeneration.

In addition, due to the absence of any type of detent mechanism between the plug and socket, there exists an uncertainty as to what constitutes a fully inserted position of the plug. In use, the plug is merely inserted into the socket until mechanical resistance is encountered, and the user then assumes that the plug is fully seated, and positioned for use.

SUMMARY OF THE INVENTION

The above disadvantages and drawbacks of prior accessory plugs are largely obviated by the present invention, which has for an object the provision of a novel and improved accessory plug which is both simple in construction and reliable in operation and use, and is capable of safely carrying relatively higher currents than those plugs presently available and in use.

A related object of the invention is to provide an improved electrical accessory plug as above set forth, which is characterized by increased contact pressures compared to that of a conventional accessory plug, resulting in less contact resistance heating, reduced voltage drop, and more reliable operation under high current conditions.

Still another object of the invention is to provide an improved electrical accessory plug of the kind outlined above, wherein a mechanical detent structure that cooperates with bimetal fingers in the socket, provides a distinctive indication to the user that the plug is properly and sufficiently inserted into the socket, whereby the electrical connection established therewith can be attained with a high degree of certainty and integrity.

Yet another object of the invention is to provide an improved electrical accessory plug as above characterized, wherein little or no reliance is placed on the bimetal fingers of the socket for carrying current, thereby eliminating potential problems with resistance heating of the fingers, and inadvertent release of the same from the plug.

The above objects are accomplished, in preferred embodiment of the invention, by an electrical accessory plug adapted for insertion in the socket of an automobile cigar lighter receptacle of the type provided with a grounded shell and live resilient clip contact fingers that have a rigid mounting, the plug comprising a plug body having a pair of circuit means for connection to an electrical cord, and having at its inner end a retainer shoulder adapted to engage and to be frictionally embraced and retained by the live contact fingers of the cigar lighter receptacle, and a spring-biased contact plunger carried at the inner end of the plug body and connected to one of the circuit means. When the plug body is positioned deeply in the receptacle, the contact plunger is adapted for abutting engagement under spring pressure, with the rigid mounting of the contact fingers of the cigar lighter receptacle, to thereby establish firm, low-resistance electrical contact between the plunger and mounting.

The objects are further accomplished by a separable electrical receptacle and plug assemblage comprising a tubular receptacle shell having a closed end and having an opening at its other end to enable the shell to receive and hold an electrical plug, the shell having electrical contact means on a side wall thereof, and having live interior resilient electrical contact fingers which have a rigid mounting. The fingers are insulatedly carried inside the closed end of the shell. The plug has a body adapted for insertion in the shell, the body having a pair of circuit means for connection to an electrical cord, and having at its inner end a retainer shoulder adapted to engage and to be frictionally embraced and retained by the contact fingers of the cigar lighter receptacle. The plug further has spring finger means on its side, for engagement with the contact means of the shell. In addition, there is a spring-biased contact plunger carried at the inner end of the plug body and connected to one of the circuit means. When the plug body is positioned deeply in the receptacle, the plunger abuttingly engages under spring pressure, the rigid mounting of the contact fingers of the cigar lighter receptacle, to thereby establish firm, low-resistance electrical contact between the plunger and mounting.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 1:
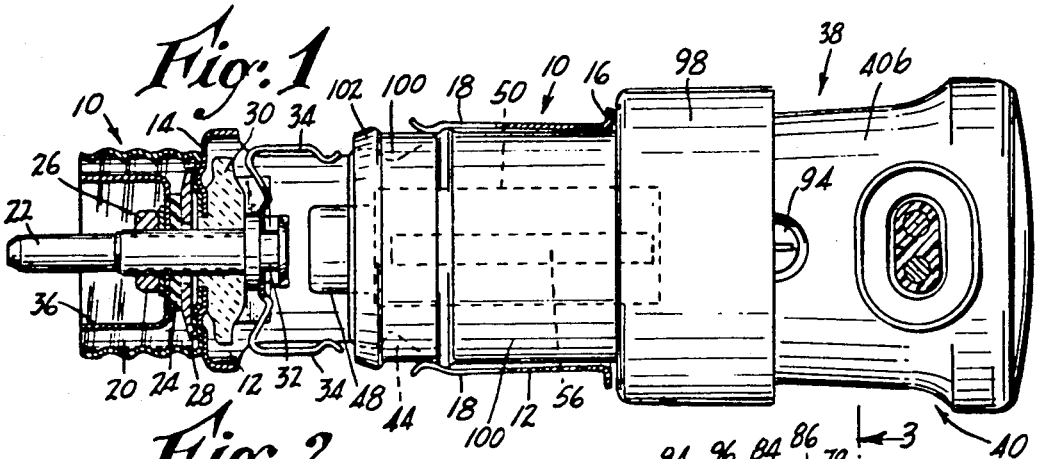
FIG. 1 is a front view, partly in elevation and partly in section, of the improved electrical accessory plug of the invention, shown installed in an electrical socket or receptacle, the plug being disposed in a storage, or non-energized position.
Figure 2:
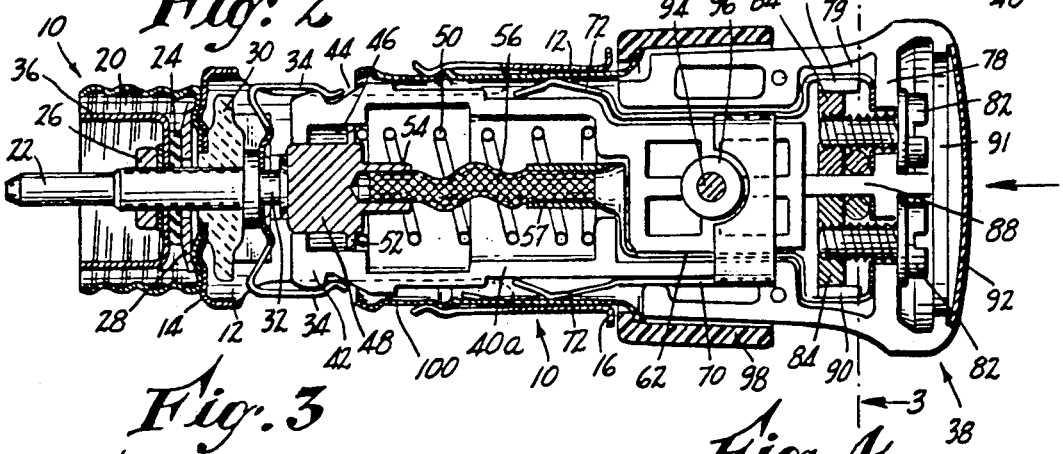
FIG. 2 is a view like FIG. 1, except with the accessory plug shown in section and occupying a fully depressed, energized position in the socket or receptacle.

Referring first to FIGS. 1 and 2 there is illustrated a cigar lighter receptacle for automobiles, recreational vehicles, and the like, generally designated by the numeral 10. The receptacle 10 comprises a drawn sheet metal shell 12 having a closed end 14 and an opposite open end. The shell 12 is normally installed in an opening of an automotive dashboard or other panel. The open end of the shell has a circular outwardly extending flange 16 which engages the front surface of the dashboard or panel (not shown). The side of the shell 12 has two oppositely-disposed spring retainer and positioning fingers 18 formed by stamping, the fingers having angled ends for sliding engagement with a plug body to be described below.

At the closed end 14 of the sheet-metal shell there is a threaded barrel 20 also in the form of a drawn shell adapted to be engaged by a cooperable clamping member (not shown) of conventional construction. Thus the receptacle 10 can be secured by such a clamping member, from the rear of the panel and in a known manner.

The receptacle 10 further comprises an electrically hot, threaded contact stud 22 having a smooth end portion to receive a suitable push-on type electrical terminal (not shown). The stud 22 is secured in an aperture in the bottom transverse wall 14 of the shell 12. Also included in the mounting assembly for the stud is an insulating washer 24, a nut 26, a clamping washer 28, and a ceramic insulating block 30. The stud 22 has a head 32 which is received in a recess in the block, and which is staked over a bimetallic strip comprising two axially extending bimetallic fingers 34. A U-shaped bimetal component 36, constituting a safety overheat shunt is optionally provided, which functions to blow a fuse by expanding under excessive heat and electrically contacting the inner surface of the shell 20 if overheating occurs as a consequence of possible malfunction of the receptacle, or of a cigar lighter ignitor plug.

Figure 13:
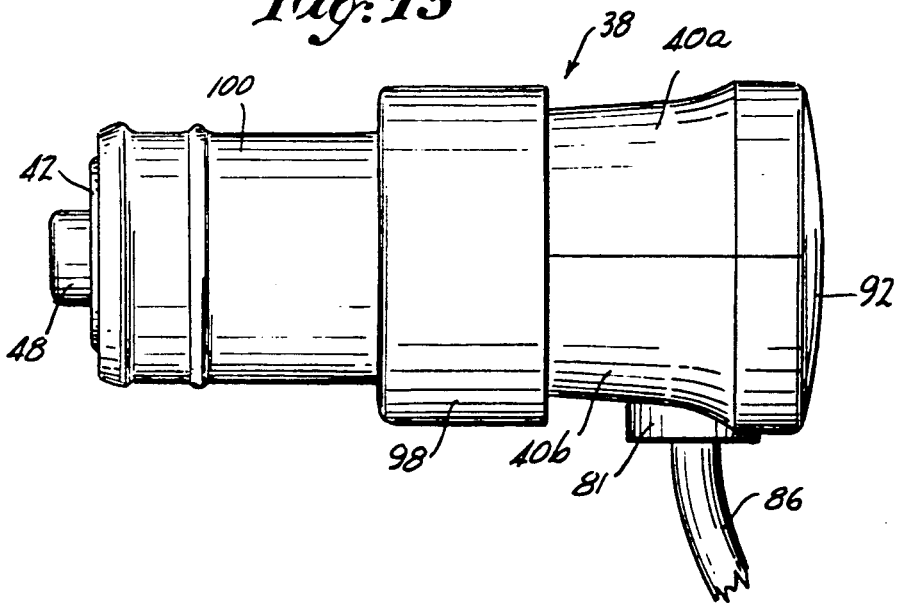
FIG. 13 is a side elevation of the accessory plug of FIGS. 1 and 2, and illustrating the electric cord extending therefrom.

Referring again to FIGS. 1, 2 and 13 and in accordance with the present invention there is provided a novel and improved high-current-capacity accessory plug 38 adapted for insertion in the receptacle 10, and moveable therein between a fully depressed, energized position, and a retracted, de-energized position. The depressed position is illustrated in FIG. 2, whereas the retracted position is shown in FIG. 1.

Figure 3:
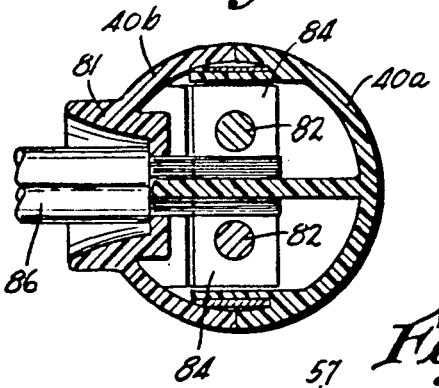
FIG. 3 is a transverse section taken on the line 3—3 of FIG. 2.
Figure 4:
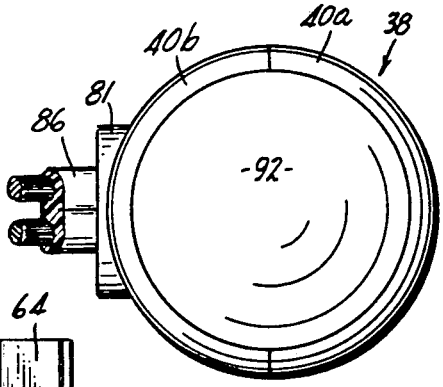
FIG. 4 is a front elevation of the accessory plug, and showing a two-conductor electric cord extending from the plug body.
Figure 6:
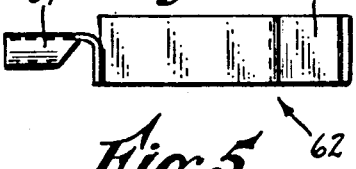
FIG. 6 is a top plan view of the sheet-metal strip of FIG. 5.
Figure 7:
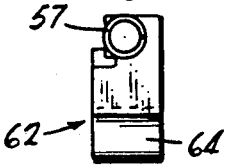
FIG. 7 is a left end elevation of the sheet-metal strip of FIGS. 5 and 6.
Figure 5:
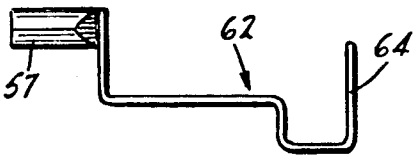
FIG. 5 is a front elevation of one of two sheet-metal conductive strips employed in the plug, to provide terminal connections to the electric cord.
Figure 8:
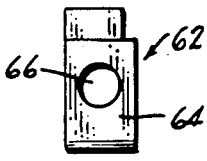
FIG. 8 is a right end elevation of the sheet-metal strip of FIGS. 5-7.
Figure 10:
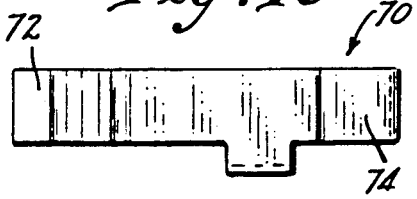
FIG. 10 is a top plan view of the sheet-metal strip of FIG. 9.
Figure 12:
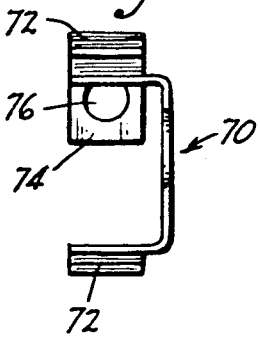
FIG. 12 is a left end elevation of the sheet-metal strip of FIGS. 9-11.

The plug 38 comprises an elongate plug body 40 which can be of molded plastic, preferably constituted of mating halves 40*a* and 40*b* which are joined along an axial plane, as in FIGS. 2, 3 and 4. The halves can be economically molded to include clearance spaces for sheet-metal conductor strips to be described below, and to provide space for screw terminals for connection to the conductors of an electric cord also to be described.

In accomplishing an important object of the invention, the plug 38 is provided with an annular external shoulder 42 defining a retention groove 44 to receive the extremities of the bimetal fingers 34. The shoulder 42 is preferably molded integrally with the body 40 of the plug 38. Under such circumstances, namely where the shoulder 42 is electrically non-conductive, the engagement of the shoulder 42 by the bimetal fingers 34 does not result in any current flow through the bimetal fingers themselves. As a consequence, in accordance with the invention, resistance heating of the fingers 34 does not occur, and there is thus no tendency for the fingers 34 to spread or release their grip on the plug body 40.

The inner end of the plug body 40 has a bore 46 that slidably carries an electrically conductive plunger 48 having external bearing surfaces that slide along cooperable slide surfaces of the bore. Carried inside the plug body is a compression spring 50 which engages the plunger 48 and biases it in an axially outward direction. The plunger 48 is held captive in the bore 46 by an annular flange 52 as shown.

The plunger 48 has at its inner end, a connector sleeve 54 in which there is inserted and crimped one end of a current-carrying braid 56. The braid 56 extends through the spring 50 to a crimped connector ferrule 57 of a first sheet-metal conductive strip 62 particularly illustrated in FIGS. 5-8. The strip 62 has at its outermost end a terminal portion 64 with a hole 66 to receive a screw, as will be further explained.

Figure 9:
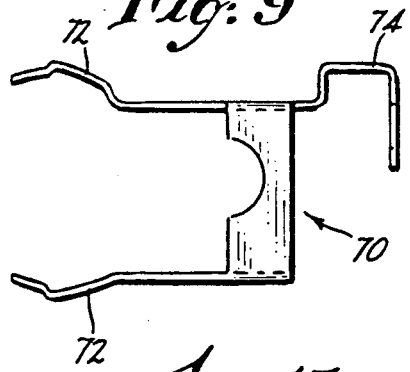
FIG. 9 is a front elevation of the other of the sheet-metal strips employed in the plug, to provide terminal connections to the electric cord.
Figure 11:
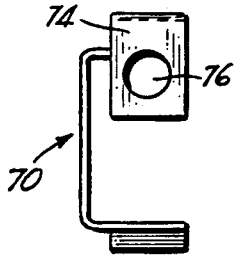
FIG. 11 is a right end elevation of the sheet-metal strip of FIGS. 9 and 10.

A second sheet-metal conductive strip 70 shown in FIGS. 9-12, is carried in the plug body 40, and has oppositely located contact fingers 72, FIG. 9. This second strip 70 has a forward or outermost terminal portion 74 with a hole 76 similar to that of the first sheet-metal strip 62, to receive a second screw.

In a preferred form of the invention, the plug body 40 has a transverse apertured partition wall 78, FIG. 2, in its outer end, behind which is a clearance space 79. Received in the apertures of the wall are two screws 82 that are retained by captive nuts 84 located behind the wall 78 and in the clearance space 79. Also, the terminal portions of the sheet-metal strips 62 and 70 extend into the space 79. There is provided a side port 81 on the body 40 and a two-conductor electric cord 86 enters the body therethrough. One conductor of the cord 86 is positioned between the terminal portion 64 of one sheet-metal strip 62 and a nut 84, whereas the other conductor is positioned between the terminal portion 74 of the other sheet-metal strip 70 and a nut 84. Shoulder formations 86, 88 and 90, FIG. 3, on opposite sides of each nut 84 restrain them against rotation with the respective screws 82.

At the front of the transverse wall 78 is an additional clearance space 91 by which access to the heads of the screws 82 is had. This space is normally concealed by a pressed-on cover plate 92, to provide a neat finished appearance to the plug when viewed from the front thereof.

The two halves of the plug body 40 are secured together by an assembly screw 94 which can be seen in FIG. 1, this being receivable in a cooperable threaded hole in a block 96 of the mating body half. Surrounding the assembled halves is an annular collar 98, which is captive on the plug body 40, and which is carried by a friction sleeve or ash-guard 100 which has an external annular bead 102 that functions as a yieldable detent along with the spring fingers 18.

In connecting the electric cord 86 to the plug 38, the insulation is stripped off the two conductors of the cord 86, and the wires inserted through the side port of the body such that they occupy the space between the terminal portions 64, 74 respectively of the sheet-metal strips 62 and 70, and the two nuts 84. With the cover piece 92 removed, the screws 82 are then tightened so as to pull the nuts 84 up and squeeze the wires against the respective terminal portion 64, 74. The cover piece 92 is then replaced.

In operation, the plug body 40 is inserted in the socket 10 with the body being in a retracted position, as in FIG. 1, until the collar 98 engages the flange 16, the collar 98 constituting a positioning device or stop for the plug 38. In this position of the plug, the braid 56 is relatively straight or taut, FIG. 1, and the compression spring 50 is in an extended position as compared to FIG. 2.

In order to energize the plug 38 and establish continuity between the conductors of the electric cord 86 and the contacts 22, 12 of the socket, the forward end of the knob of the plug adjacent the cover piece 92 is depressed as in FIG. 2. The collar 98 is slidable on the plug body 40 and remains stationary. The plunger 48 is brought into engagement with the rigid mounting 32 for the bimetal fingers 34 of the socket during the depression of the plug body, and such engagement causes a retraction of the plunger 48 with respect to the body, against the action of the spring 50. Upon complete depression of the plug body, the plunger will be retracted with respect thereto, as in FIG. 2. The electrically hot side of the circuit is thus established from the stud 22, through the plunger 48 and braid 56, through the crimping ferrule 57 of the sheet-metal strip 62, and to the terminal portion 64 thereof and the one conductor of the electric cord 86.

The electrical ground side of the circuit is established by the continuous, sliding engagement of the spring fingers 72 of the other sheet-metal strip 70 with the inner surface of the side wall of the socket 12. The ground circuit is completed through the strip 70 to the terminal portion 74, and to the other conductor of the electric cord 86.

By the invention, in the fully depressed, energized position of the plug 38, FIG. 2, the resilience of the bimetal fingers 34 retains the plug. Current flow from stud 22 is exclusively through the plunger 48 and braid 56. No current flow occurs through the fingers 34, which could otherwise result in undesirable resistance heating of the fingers themselves, and possible inadvertent release of the plug by the fingers. In accomplishing the desired isolation of the fingers 34 from the electric current path, the shoulder 42 is constituted of plastic molded integral with the plug body 38, or as an alternative, in the event that a metal shoulder is employed, the metal can be mounted in the plug body in an electrically insulated manner.

When it is desired to de-energize the plug, the knob is pulled gently, causing the shoulder 42 to force the bimetal fingers 34 radially outwardly and by-pass them. As the plug body is withdrawn, the plunger resumes its advanced initial position in the body, corresponding to FIG. 1.

The disclosed arrangement has the distinct advantage of eliminating uncertainty as to the condition of the plug. With prior plugs, there was usually no indication as to whether they were energized or not. If they were fully inserted and were operating properly, the desired circuit would most likely be established. However, if such a conventional plug were slightly withdrawn, the circuit would be opened, resulting in inadvertent interruption in the current flow.

In contrast, with the arrangement of the present invention, there is eliminated such uncertainty. The plug 38, when first installed, is depressed until a slight mechanical resistance is encountered, this being the position of FIG. 1. The mechanical resistance is provided by the engagement of the spring fingers 18 with the external bead 102. Further depression of the plug 38 overcomes this initial mechanical resistance whereby the bead 102 by-passes the fingers 18. When the groove 44 arrives at the extremities of the bimetal fingers 34, they snap into it, and further depressing movement of the plug body is prevented by the engagement with an internal shoulder on the collar 98.

The use of simple crimp connections between the braid and plunger, and the braid and the one sheet-metal strip have been found to be economical from the manufacturing standpoint while still providing the required low-resistance path needed for high current operation.

A further advantage of the present arrangement is that the biasing spring for the plunger is isolated from the current path. Accordingly reliance on the spring as a low-resistance component of the current path is not required. Undesirable heating of the spring, which would otherwise occur, is also avoided.

The disclosed accessory plug is thus seen to constitute a distinct advance and improvement in the field of automotive and marine accessories.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. An electrical accessory plug adapted for insertion in the socket of an automobile cigar lighter receptacle of the type provided with a grounded shell and live resilient clip contact fingers which have a rigid mounting, comprising in combination:

a) a plug body having a pair of circuit means for connection to an electrical cord, and having at an inner end a retainer shoulder adapted to engage and to be frictionally embraced and retained by the live clip contact fingers of the cigar lighter receptacle, and b) a spring-biased contact plunger carried at the inner end of said plug body and connected to one of said circuit means, said contact plunger being adapted for abutting engagement under spring pressure, when the plug body is positioned deeply in the receptacle, with the rigid mounting of the contact fingers of the cigar lighter receptacle.

2. The invention as set forth in claim 1, wherein:

a) said retainer shoulder is electrically insulated from the pair of circuit means.

3. The invention as set forth in claim 1, wherein:

a) said retainer shoulder is constituted of electrically insulating material.

4. The invention as set forth in claim 1, wherein:

a) said circuit means comprises screw means adapted to respectively clamp conductors of the electrical cord.

5. The invention as set forth in claim 1, wherein:

a) said shoulder and body are constituted of plastic, said shoulder being integrally molded on said body.

6. The invention as set forth in claim 1, wherein:

a) said retainer shoulder is substantially annular.

7. The invention as set forth in claim 6, wherein:

a) said plunger has spaced-apart slide bearing portions, said plug body having a bore in one end, in which the bearing portions of the plunger slide, the retainer shoulder of said body being disposed adjacent said body end.

8. The invention as set forth in claim 1, and further including:

a) a flexible braid connecting said plunger to said one circuit means.

9. The invention as set forth in claim 8, and further including:

a) a compression spring carried in said body, encircling said braid.

10. The invention as set forth in claim 1, wherein:

a) said circuit means comprises sheet-metal strips having terminal portions and screws cooperable with said terminal portions, to clamp the conductors respectively of the electrical cord.

11. The invention as set forth in claim 10, wherein:

a) one strip has oppositely-located contact fingers adapted to engage opposite wall areas of a cigar lighter receptacle.

12. The invention as set forth in claim 10, wherein:

a) said body has an accessible space in which the screws are located, and b) a cover mounted on said body, concealing said screws and space.

13. A separable electrical receptacle and plug assemblage comprising, in combination:

a) a tubular receptacle shell having a closed end and having an opening at another end to enable the shell to receive and hold an electrical plug, said shell having electrical contact means on a side wall thereof, and having live interior resilient electrical contact fingers which have a rigid mounting, said fingers being insulatedly carried inside the closed end of the shell, b) a plug body adapted for insertion in said shell, said plug body having a pair of circuit means for connection to an electrical cord, and having at its inner end a retainer shoulder adapted to engage and to be frictionally embraced and retained by the contact fingers of said cigar lighter receptacle, said plug further having spring finger means on its side, for engagement with the contact means of the shell, and c) a spring-biased contact plunger carried at the inner end of said plug body and connected to one of said circuit means, said plunger being adapted for abutting engagement under spring pressure, when the plug body is positioned deeply in the receptacle, with the rigid mounting of the contact fingers of the cigar lighter receptacle.

14. The invention as set forth in claim 13, wherein:

a) said retainer shoulder is substantially annular, b) said contact fingers being two in number and disposed opposite one another.

15. The invention as set forth in claim 13, wherein:

a) said electrical contact means comprises said side wall of the shell, b) said plug having a plurality of side fingers engaging said side wall.

* * * * *